US005423267A

United States Patent [19]

Eklund

[11] Patent Number: 5,423,267

[45] Date of Patent: Jun. 13, 1995

[54] POCKET RERAILER

[76] Inventor: Byron G. Eklund, 705 Easy St., Green River, Wyo. 82935

[21] Appl. No.: 175,926

[22] Filed: Dec. 30, 1993

[51] Int. Cl.[6] ..... B61K 5/06

[52] U.S. Cl. ..... 104/264; 104/265; 104/274

[58] Field of Search ..... 104/262, 264–274

[56] References Cited

U.S. PATENT DOCUMENTS 1,001,213 8/1911 Moynihan ..... 104/268
1,109,369 9/1914 Smith ..... 104/274

OTHER PUBLICATIONS

*Aldon,* Railway, Trucking, & Material Handling Products, 1990 pp. 17 and 18.

*Primary Examiner*—Robert J. Obertleitner

*Assistant Examiner*—Linh Do

*Attorney, Agent, or Firm*—Zarley, McKee, Thomte, Voorhees & Sease; Dennis L. Thomte

[57] ABSTRACT

A rerailing device for rerailing a wheel of a railcar or the like which has been derailed due to a spread rail comprising an L-shaped metal bar member including a vertically disposed bar portion and a horizontally disposed bar portion which extends horizontally from the upper end of the vertically disposed bar portion. A vertically disposed flat metal plate is secured to one side of the vertically disposed bar portion and extends horizontally therefrom beneath one side of the horizontally disposed bar portion. The rerailer may be of the left-hand or right-hand type to enable the rerailer to be mounted at either end of a rail joint bar so that the derailed wheel may be brought into engagement therewith and moved upwardly thereonto to retail the derailed wheel.

4 Claims, 3 Drawing Sheets

POCKET RERAILER

BACKGROUND OF THE INVENTION

1. Field of the Invention

This invention relates to a rerailer and more particularly to a pocket rerailer for use in rerailing a railcar or locomotive which has been derailed due to a spread rail.

2. Background Information

Railcars and locomotives are frequently derailed due to a spread rail. When a rail has spread, one or more wheels of the railcar or locomotive derail inwardly of the spread rail. Many types of car and engine replacers and rerailers have been previously provided but they all suffer from one or more disadvantages. Perhaps the biggest disadvantage with the available rerailing devices is that they are extremely heavy and cumbersome which makes it difficult to position the rerailers in the proper position relative to the rail. Further, the available types of rerailers are extremely expensive and heavy, thus creating a safety problem.

SUMMARY OF THE INVENTION

A rerailing device is disclosed which may be removably positioned between the spread rail and a rail joint bar mounted thereon. The rerailing device is comprised of an L-shaped metal bar which includes a vertically disposed bar portion and a horizontally disposed bar portion. A vertically disposed flat plate is secured to one side of the vertically disposed bar portion and extends horizontally therefrom beneath one side of the horizontally disposed bar portion and outwardly thereof. When it is desired to rerail a railcar or locomotive, which has been derailed due to a spread rail, the flat metal plate of the rerailing device is inserted between a rail joint bar and the spread rail so that the upper end of the horizontally disposed bar portion is in approximately the same plane as the top of the spread rail. The car is then moved towards the rerailing device so that the tread of the derailed wheel engages the device and moves up onto the top of the horizontally disposed bar portion and subsequently back onto the rail. The devices are made in right and left models for attachment to either end of the rail joint bar depending upon the location of the derailed wheel with respect to the rail joint bar.

It is a principal object of the invention to provide an improved rerailing device.

A further object of the invention is to provide an improved rerailing device including right and left-hand devices which may be selectively secured to opposite ends of a rail joint bar.

Yet another object of the invention is to provide a pocket rerailer which is inexpensive to manufacture.

Still another object of the invention is to provide a pocket rerailer which is comparatively light and which is easy to use.

Still another object of the invention is to provide a pocket rerailer which is durable in use and refined in appearance.

These and other objects will be apparent to those skilled in the art.

BRIEF DESCRIPTION OF THE DRAWINGS

FIG. 5 is a side view illustrating the manner in which the pocket rerailer is being used to rerail a wheel of a railcar or the like;

DESCRIPTION OF THE PREFERRED EMBODIMENT

Figure 2:
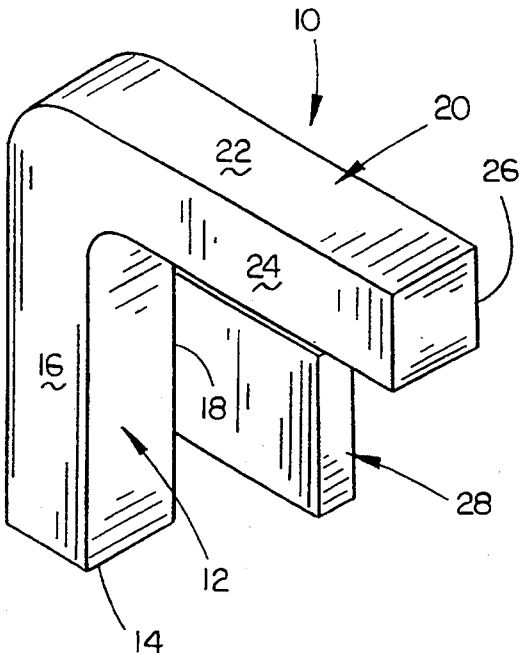
FIG. 2 is a perspective view of the left-hand version of the pocket rerailer.
Figure 3:
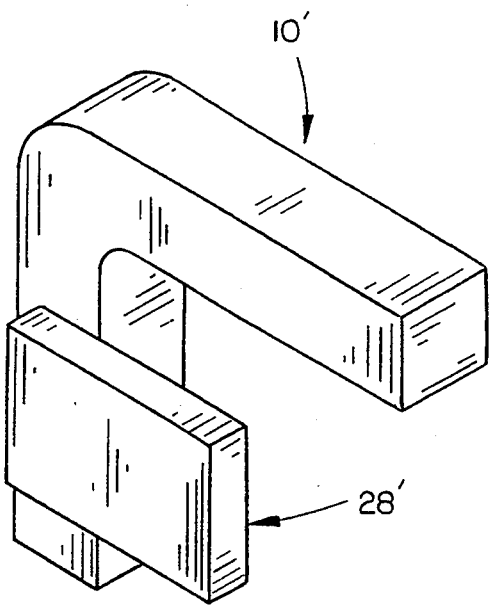
FIG. 3 is a perspective view of the right-hand version of the pocket rerailer.

As seen in FIG. 2, the numeral 10 refers to the left-hand version of the pocket rerailer of this invention. In FIG. 3, the numeral 10' refers to the right-hand version of the pocket retailer.

Rerailer 10 is in the form of an L-shaped metal bar member including a vertically disposed bar potion 12 having a lower end 14, outer surface 16 and inner surface 18. Rerailer 10 also includes a horizontally disposed bar portion 20 which extends horizontally from the upper end of vertically disposed bar potion 12 and which has a top surface 22, an outer surface 24 and an inner surface 26. A vertically disposed flat plate 28 is welded or otherwise secured to inner surface 18 of bar potion 12 and extends horizontally therefrom beneath horizontally disposed bar portion 20 outwardly of inner surface 26.

Figure 1:
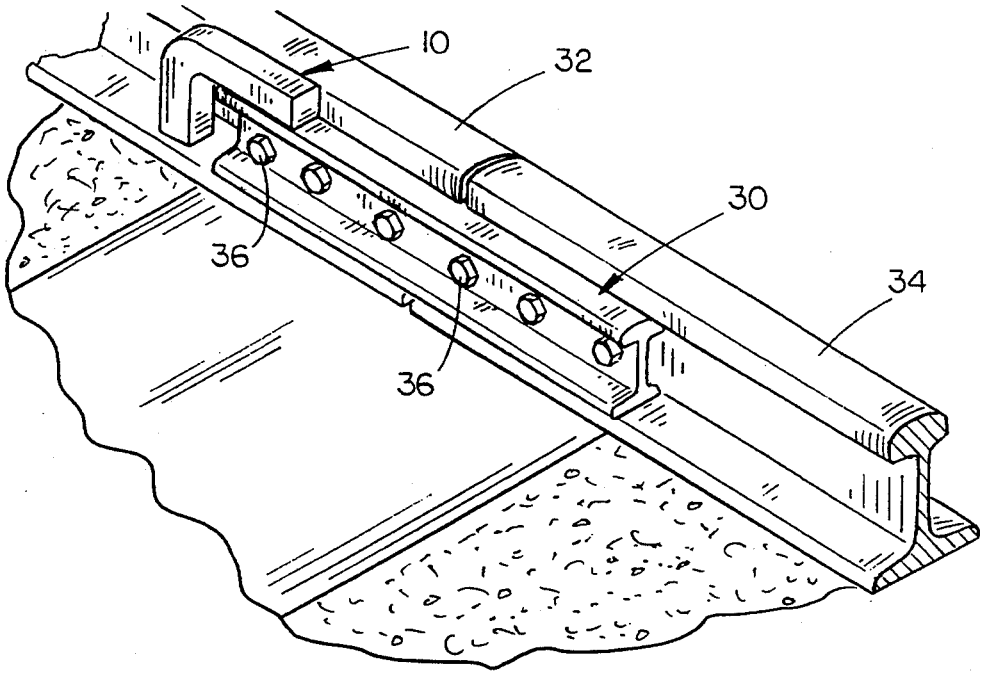
FIG. 1 is a perspective view illustrating the pocket rerailer being mounted at one end of a rail joint bar.
Figure 4:
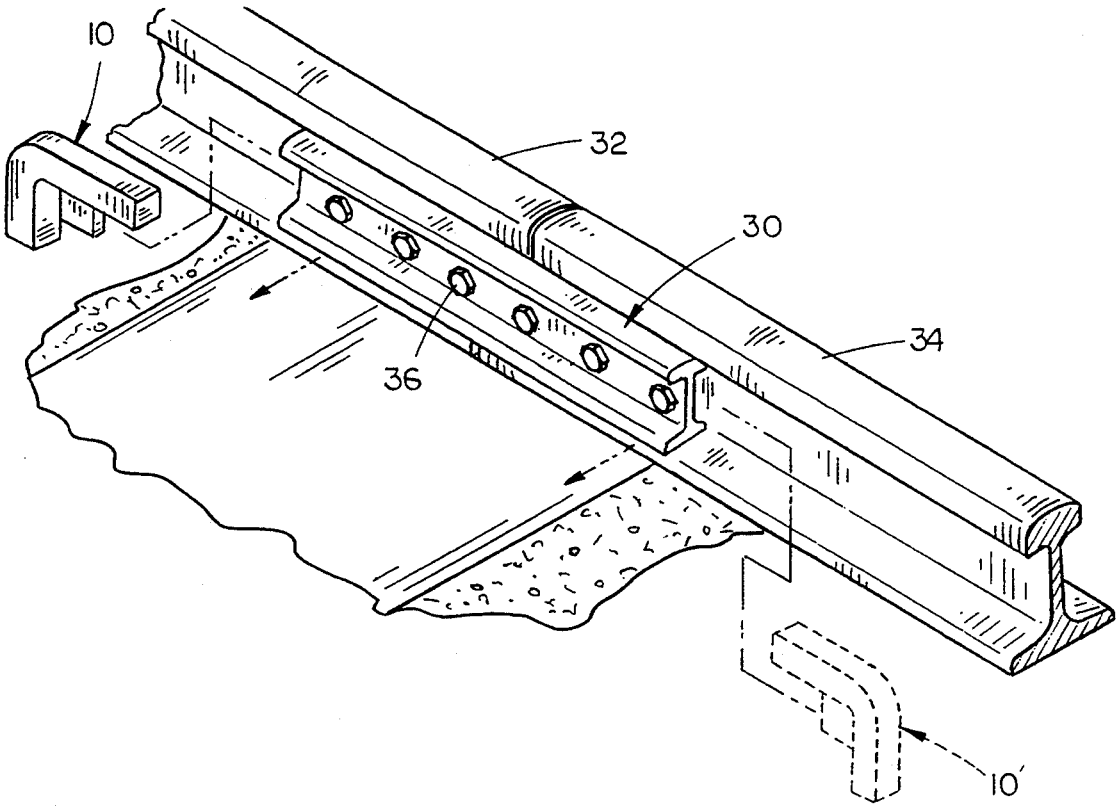
FIG. 4 is a perspective view illustrating the manner in which the pocket rerailers may be secured to the ends of the rail joint bar.

Rerailer 10' is identical to rerailer 10 except that it is the right-hand version thereof which is created by simply securing the flat metal plate 28' to the other side of vertically disposed bar portion 12. Left-hand rerailer 10 is designed to be used at the left end of a rail joint bar 30 which is secured to and positioned at the joint of rails 32 and 34. If the derailed wheel is to the left of the rail joint bar 30 as seen in FIG. 1, the left-hand rerailer 10 will be utilized. If the derailed wheel is to the right of the rail joint bar 30, as viewed in FIG. 1, then the right-hand version 10' of the rerailer will be inserted at the right end of the bar 30 as illustrated by broken lines in FIG. 4. In either case, the rerailers are inserted between the rail joint bar 30 and the side of the rails 32 or 34.

The vertically disposed portion 12 of the rerailer has a length sufficient so that when the plate 28 is installed or positioned between the bar 30 and the side of the associated rail, the top surface 20 of the rerailer will be approximately at the same plane as the top surface of the associated rail.

Figure 5:
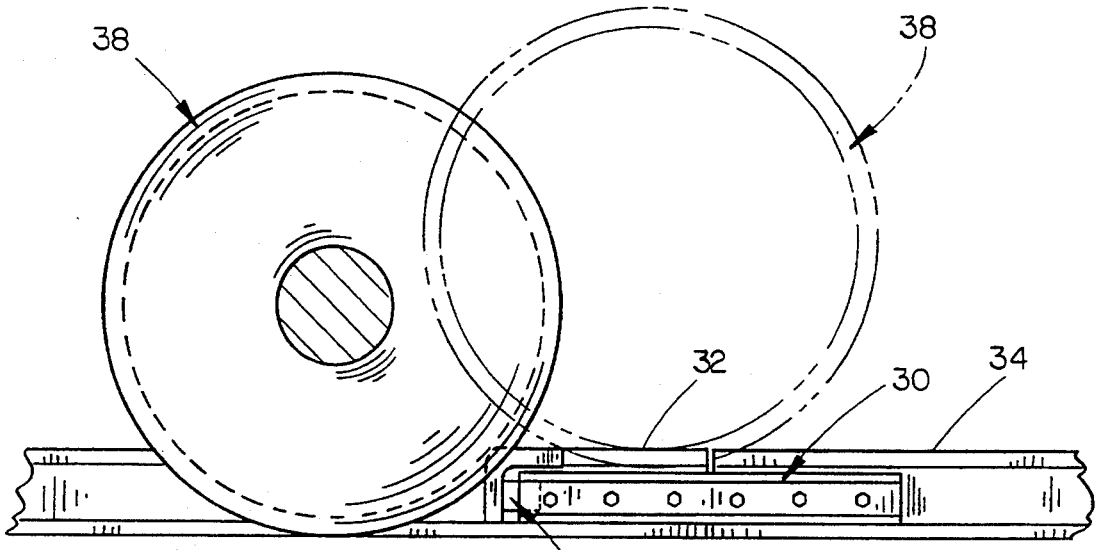
Figure 6:
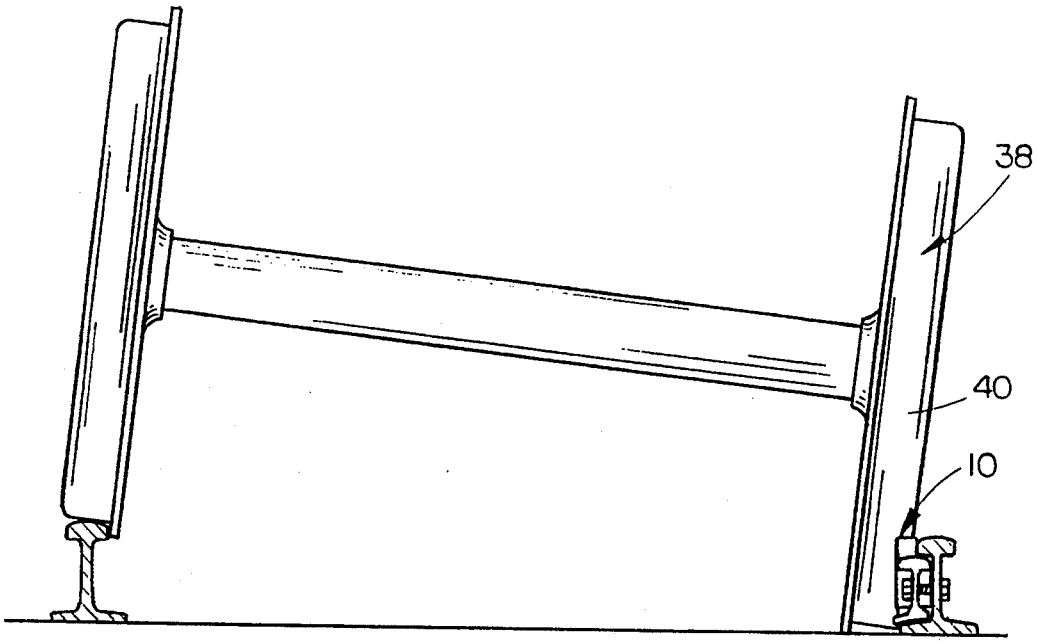
FIG. 6 is an end view illustrating the relationship of the derailed wheel with respect to the pocket rerailer prior to the railcar or the like being moved thereonto.
Figure 7:
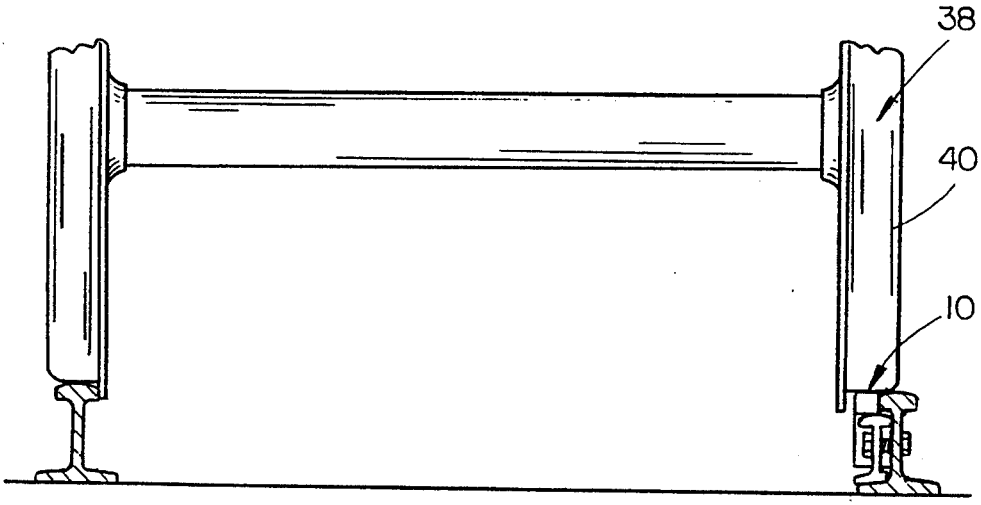
FIG. 7 is a view similar to FIG. 6 except that the derailed wheel has been moved upwardly onto the top of the pocket rerailer.
Figure 8:
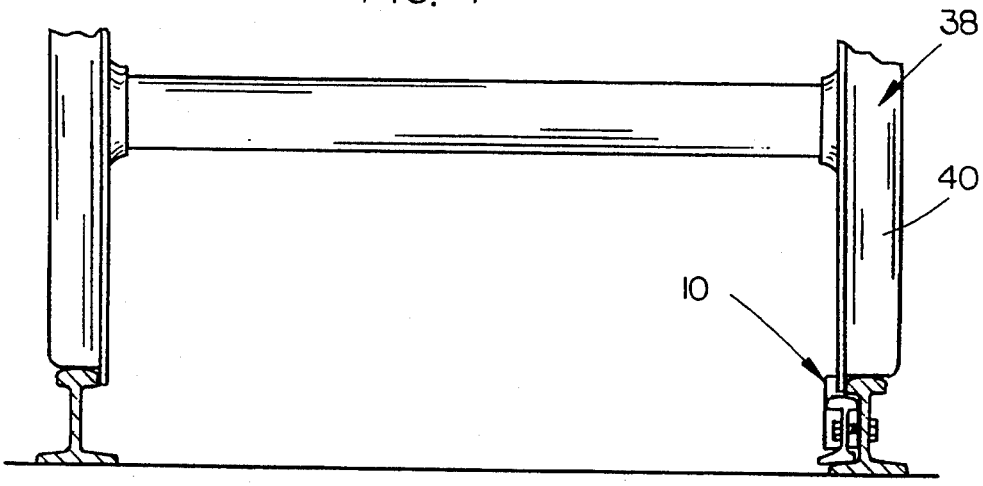
FIG. 8 is a view similar to FIG. 7 except that the spread rail has been moved inwardly so that the rail is properly positioned on the rail.

As seen in FIG. 5, assuming that the derailed wheel 38 is to the left of the rail joint bar 30 as depicted therein, the rerailer 10 is installed at the end of the bar 30 as previously described. A "come-along" device could be extended between the spread rail and the opposite rail with inward force being applied to the spread rail to urge the spread rail towards the opposite rail. The railcar or locomotive is then moved slowly towards the rerailer 10 so that the tread 40 of the wheel 38 engages the rerailer 10. Continued movement of the wheel 38 with respect to the rerailer 10 will cause the wheel to move upwardly thereon so that the tread 40 of the wheel 38 rests upon the upper or top surface 20 of the rerailer 10. The inward force exerted on the spread rail by the "come-along", which is not a part of this invention, assists in the spread rail being pulled inwardly from the position of FIG. 7 to the position of FIG. 8 so that the wheel 38 will be properly rerailed on the rail.

Thus it can be seen that a novel rerailer has been described which is inexpensive to manufacture but which is extremely easy to use. Further, the rerailer of this invention is quickly installed on the rail joint bar and may be easily and quickly removed therefrom after the wheel has been rerailed. Thus it can be seen that the invention accomplishes at least all of the stated objectives.

I claim:

1. A rerailing device for rerailing a wheel of a railcar which has been derailed due to a spread rail, comprising:

an L-shaped bar member including a vertically disposed bar portion having an upper end, a lower end and opposite sides, and a horizontally disposed bar portion extending horizontally from the upper end of said vertically disposed bar portion and having opposite sides and a top surface;

and a flat plate oriented in a vertical plane secured to said vertically disposed bar portion and extending horizontally therefrom parallel and spaced below said horizontally disposed bar portion.

2. The device of claim 1 wherein said flat plate is mounted with a lower edge spaced above the lower end of said vertically disposed bar portion and an upper edge spaced below the upper end of said vertically disposed bar portion so that said flat plate may be inserted between the inside of a rail and a rail joint bar secured to said rail whereby said top surface of said horizontally disposed bar portion will be positioned in substantially the same plane as the top of the rail.

3. The rerailing device of claim 1, wherein said plate is secured to one side of said vertically disposed bar portion.

4. A pair of rerailing devices for rerailing a wheel of a railcar which has been derailed due to a spread rail, comprising:

a first L-shaped bar member including a vertically disposed bar portion having an upper end, a lower end, and first and second sides; a horizontally disposed bar portion extending horizontally from the upper end of said vertically disposed bar portion and having first and second sides; a flat plate oriented in a vertical plane secured to said first side of said vertically disposed bar portion and extending horizontally therefrom parallel and spaced below said first side of said horizontally disposed bar portion;

a second L-shaped bar member including a vertically disposed bar portion having an upper end, a lower end, and first and second sides; a horizontally disposed bar portion extending horizontally from the upper end of said vertically disposed bar portion and having first and second sides; a flat plate oriented in a vertical plane secured to said second side of said vertically disposed bar portion of said second L-shaped bar member and extending horizontally therefrom parallel and spaced below said second side of said horizontally disposed bar portion of said second L-shaped bar member.

* * * * *